US009480997B2

(12) United States Patent
Gang

(10) Patent No.: US 9,480,997 B2
(45) Date of Patent: Nov. 1, 2016

(54) MULTIFUNCTIONAL ELECTRIC SPRAY GUN

(71) Applicant: Taizhou Luxi Tools Company, Ltd., Wenling, Zhejiang Province (CN)

(72) Inventor: Pan Xing Gang, Wenling (CN)

(73) Assignee: Taizhou Luxi Tools Company, Ltd., Wenling (CN)

( * ) Notice: Subject to any disclaimer, the term of this patent is extended or adjusted under 35 U.S.C. 154(b) by 282 days.

(21) Appl. No.: 14/452,788

(22) Filed: Aug. 6, 2014

(65) Prior Publication Data

US 2015/0190826 A1 Jul. 9, 2015

(30) Foreign Application Priority Data

Jan. 8, 2014 (CN) ..... 2014 2 0011642 U

(51) Int. Cl.

*B05B 7/02* (2006.01)
*B05B 7/08* (2006.01)
*B05B 7/24* (2006.01)

(52) U.S. Cl.

CPC ..... *B05B 7/2464* (2013.01); *B05B 7/0823* (2013.01); *B05B 7/241* (2013.01); *B05B 7/2416* (2013.01); *B05B 7/2472* (2013.01)

(58) Field of Classification Search

CPC ..... B05B 7/02; B05B 7/0823; B05B 7/2402; B05B 7/2405; B05B 7/2408; B05B 7/241; B05B 7/2416; B05B 7/2418; B05B 7/2464; B05B 7/2472; B05B 9/01

USPC ..... 239/296, 332, 333, 373, 525, 526, 600

See application file for complete search history.

(56) References Cited

U.S. PATENT DOCUMENTS 4,301,971 A * 11/1981 Cornelius ..... B05B 7/2437 222/401
6,547,161 B1 * 4/2003 Huang ..... B05B 7/0815 239/290
7,703,704 B2 * 4/2010 Gohring ..... B05B 7/2408 220/4.07
D615,614 S * 5/2010 Tullney ..... D23/225
7,857,242 B2 * 12/2010 Huang ..... B05B 9/0861 239/333
7,946,510 B2 * 5/2011 Huang ..... B05B 7/0815 239/290
2005/0269425 A1 * 12/2005 Gohring ..... B05B 7/2416 239/398

(Continued)

FOREIGN PATENT DOCUMENTS

CN 203227576 U 10/2013

*Primary Examiner* — Darren W Gorman
(74) *Attorney, Agent, or Firm* — Christensen O'Connor Johnson Kindness PLLC

(57) ABSTRACT

A multifunctional electric spray gun, comprising: a handle, a pump, and a plurality of painting components, the pump is connected to the handle, and each one of the painting components can respectively be fastened to the handle in a detachable fashion to form the electric spray gun, the painting component consists of a gun pipe and a paint tank connected with the gun pipe, and the gun pipe is fastened to the handle in a detachable fashion. The multifunctional electric spray gun of the present utility model has the following advantages: the present spray gun comprises a handle and a plurality of painting components, each painting component can be fastened to the handle in a detachable fashion and forms an electric spray gun. While using the spray gun, different paint tanks can be filled with different colors of paints. Painting different colors can be achieved by fastening different painting components to the handle. Therefore, one spray gun can be used for different purposes; thus it increases the painting efficiency and reduces the painting cost.

15 Claims, 6 Drawing Sheets

(56) References Cited

U.S. PATENT DOCUMENTS

2011/0114758 A1* 5/2011 Munn ..... B05B 7/0815 239/302
2011/0121103 A1* 5/2011 Carleton ..... B05B 7/0081 239/337
2011/0174900 A1* 7/2011 Munn ..... B05B 15/065 239/303
2011/0198412 A1* 8/2011 Munn ..... B05B 15/025 239/302
2013/0277458 A1* 10/2013 Zhou ..... H02K 7/145 239/375

* cited by examiner

MULTIFUNCTIONAL ELECTRIC SPRAY GUN

TECHNICAL FIELD

The present utility model relates to a liquid spraying device, in particular, a multifunctional electric spray gun.

BACKGROUND

Currently, the electric spray guns on the market have limited functions. While using the spray gun, if the project requires spraying several paints with different concentration and color, then it will require multiple electric spray guns with different functions. It dramatically increases the cost of spraying. It is also inconvenient to use, especially when working high above the ground, as it is inconvenient to carry several electric spray guns. Therefore, a function-integrated spray gun is needed; however, the main differences between electric spray guns with different functions lie within the paint passage, the air passage, and the paint tank. It is almost impossible to achieve the adjustments of paint passage, air passage and paint tank in one spray gun, but since the pumps in the electric spray guns are roughly the same, it is possible to overcome the current electric spray guns' limited functions by switching different paint passages, air passages and paint tanks while having the same pump in one electric paint gun.

SUMMARY OF THE UTILITY MODEL

To overcome the defects existing in the related prior art, the present utility model is directed to a multifunctional electric spray gun.

In one aspect, the multifunctional electric spray gun includes a handle, a pump, and a plurality of painting components, the pump is connected with the handle, each one of the painting components can respectively be fastened to the handle in a detachable fashion to form the electric spray gun, the painting component consists of a gun pipe and a paint tank to the gun pipe, and the gun pipe is fastened to the handle in a detachable fashion.

In another aspect, the multifunctional electric spray gun of the present utility model further has the following additional technical features.

An air outlet port, which communicates with the pump, is provided on the handle, an air inlet connector is provided on the gun pipe, the air inlet connector is inserted into the air outlet port and clamped onto the air outlet port.

An engagement slot is provided inside the air outlet port; a resilient plate is formed on the air inlet connector; an engagement block is provided at the moveable end of the resilient plate, and the engagement block is engaged with the engagement slot; a pressing component is provided on the resilient plate.

A triggering component is provided on the handle; a trigger is provided on the gun pipe, and the trigger engages the triggering component.

The triggering component comprises a trigger switch provided in the handle and a moving block hinged to the handle; a resilient button is provided on the trigger switch; one end of the moving block is hinged to the handle while another end is moveable; the moveable end is engaged with the resilient button, and the trigger presses the moving block in a sliding fashion.

A resilient beam is provided on the trigger switch; one end of the resilient beam is fixed to the trigger switch; a pressing portion is provided on the other end of the resilient beam; one side of the pressing portion is engaged with the resilient button; a roller is provided on the other side of the pressing portion; the moving end of the moveable block is engaged with the roller in a sliding pressing fashion; the moveable block drives the pressing portion to press the resilient button.

An adjustable trigger stopper is provided on the handle; while the trigger is pulled, the trigger engages with the trigger stopper.

The trigger stopper comprises an adjusting nut and a screw paired with each other; the rotation of the adjusting nut drives the screw to perform linear movements; the trigger is engaged with the screw while the trigger is pulled.

The adjusting nut is inlaid into the handle in a rotatable fashion; one end of the screw is inserted into the handle and paired with the adjusting nut; another end of the screw remains in the open and engages with the trigger when the trigger is pulled; the external thread of the screw is paired with the internal thread of the adjusting nut; the rotation of the adjusting nut drives the screw to perform linear movements.

A paint passage and an air passage are provided within the gun pipe, and a paint pipe and an air pressure pipe are provided at the connecting part between the paint tank and the gun pipe; the paint pipe is in communication with the paint passage, and the air pressure pipe is in communication with the air passage.

A nozzle is provided at the front end of the gun pipe; the nozzle comprises a head sealing ring, a paint nozzle, an air flow cap, and a positioning ring; a positioning hole is formed on the head sealing ring, and a positioning block is provided on the air flow cap; the positioning hole is paired with the positioning block; the paint nozzle secures the head sealing ring to the gun pipe; the positioning ring secures the air flow cap to the gun pipe in a rotatable fashion.

A rubber end cap is provided on the bottom of the handle; the rubber end cap is inserted into the handle; a hole is formed on the bottom of the handle, and an inserting block is formed on the rubber end cap; the inserting block is inserted into the hole.

In a plurality of said painting components, each paint tank has different size, and each gun pipe has different outer diameter.

A pump cavity is provided on the handle, the pump is secured inside the pump cavity.

The handle consists of a body part and a cover; the body part consists of a left cavity and a right cavity, where the left cavity is fastened to the right cavity; the cover is fastened to one end of the body part; an air hole is provided on the body part, and the air outlet port is fastened in the air hole.

A spring is also provided on the handle; the spring drives the moving block back to its original position.

A trigger spring, which drives the trigger back to its original position, and a needle seal spring, which drives a needle seal back to its original position, are provided inside the gun pipe; the needle seal spring is located inside the trigger spring.

The multifunctional electric spray gun of the present utility model in comparison with the related prior art has the following advantages. First, the multifunctional electric spray gun comprises one handle and multiple painting components, each painting component can be fastened to the handle in a detachable fashion and forms an electric spray gun. While using the spray gun, different paint tanks can be filled with different colours of paints. Painting a different colour can be achieved by fastening a different painting component to the handle. Therefore, one spray gun can be used for different purposes; thus it increases the painting efficiency and reduces the painting cost. Since each painting component is an independent component, it is easier to clean the paint passage and air passage. The fastening structure is also easy for packaging and transportation. Second, the triggering component, which controls the pump, is provided on the handle, and the trigger activates the triggering component on the handle, therefore activates the pump. Because of this structure, there is no electrical circuit between the handle and the gun pipe, which makes the product more reliable and facilitates the detachment and assembly between the handle and the gun pipe. Third, in the present utility model, the trigger slides and presses the moveable block, thus drives the moveable block to swing along the hinging axis; the moveable end of the moveable block presses the resilient button. This triggering component only has few components and a simple structure, but it has a high sensitivity; due to this structure, even after the triggering switch has been switched on by the trigger, the user is still able to control the needle seal's position inside the gun pipe; thus it makes the spray gun easier to use. Fourth, the trigger stopper in the present disclosure only has a few components and a simple structure; it is easy to use and the user is able to do minor adjustments with one hand, which improves the painting effect. Fifth, the paint pipe and the air pressure pipe are inserted into the paint tank, which not only makes the product more aesthetic, but also prevents air leaks or damage to the air pressure pipe.

DETAILED DESCRIPTION OF THE UTILITY MODEL

Figure 1:
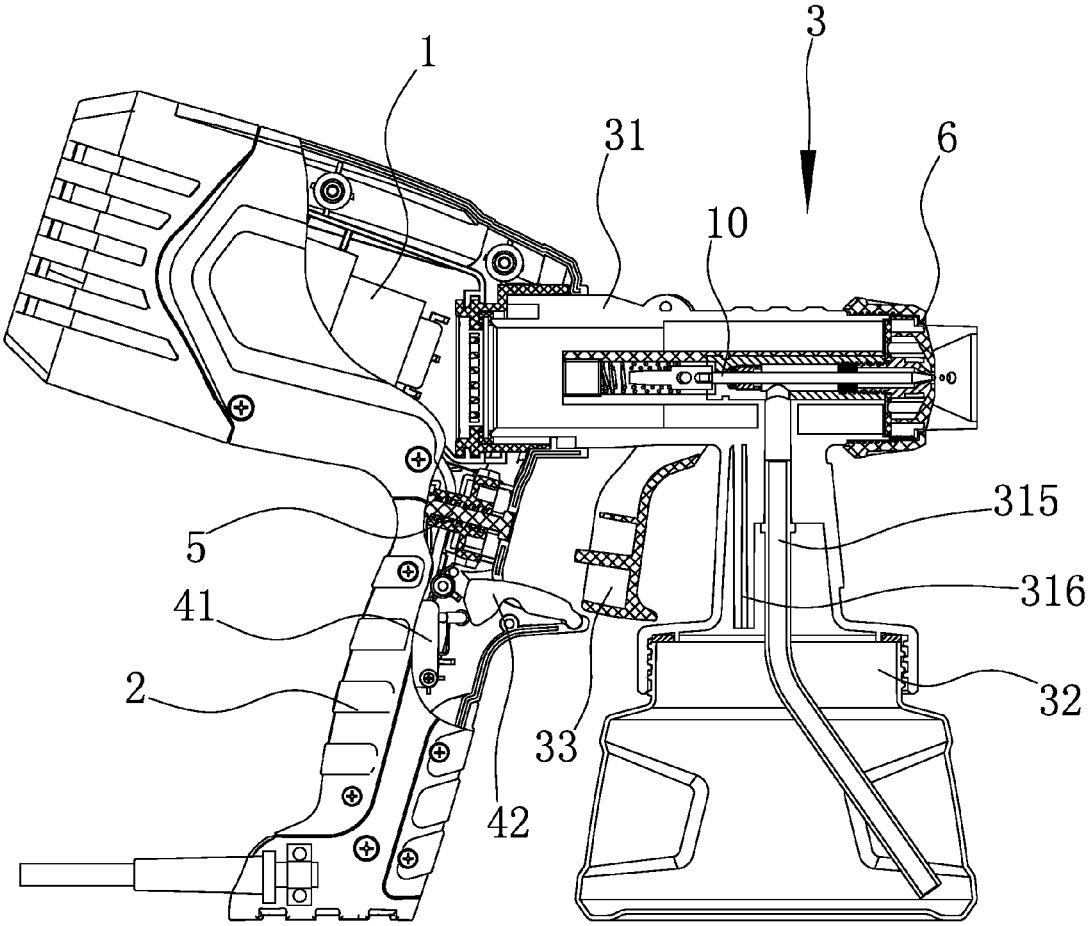
FIG. 1 is a partial cross-sectional view of the electric spray gun of the present utility model, consisting of a handle and one painting component.

Referring to FIG. 1 to FIG. 5, a multifunctional electric spray gun according to the present utility model, comprising a handle 2, a pump 1, and a plurality of painting components 3, the pump 1 is connected to the handle 2, each one of the painting components 3 can respectively be fastened to the handle 2 in a detachable fashion to form the electric spray gun, the painting component 3 consists of a gun pipe 31 and a paint tank 32 connected to the gun pipe 31, and the gun pipe 31 is fastened to the handle 2 in a detachable fashion. The present spray gun consists of a plurality of painting components 3, where each painting component 3 can respectively be fastened to the handle 2 in a detachable fashion. While the spray gun is used, different paint tanks 32 of the painting components 3 can be filled with different colours of paints. Painting a different colour can be achieved by fastening a different painting component 3 to the handle 2. Therefore, one spray gun can be used for different purposes; thus it increases the painting efficiency and reduces the painting cost. Since each painting component 3 is an independent component, it is easier to clean the paint passage and air passage. The fastening structure is also easy for packaging and transportation.

Figure 2:
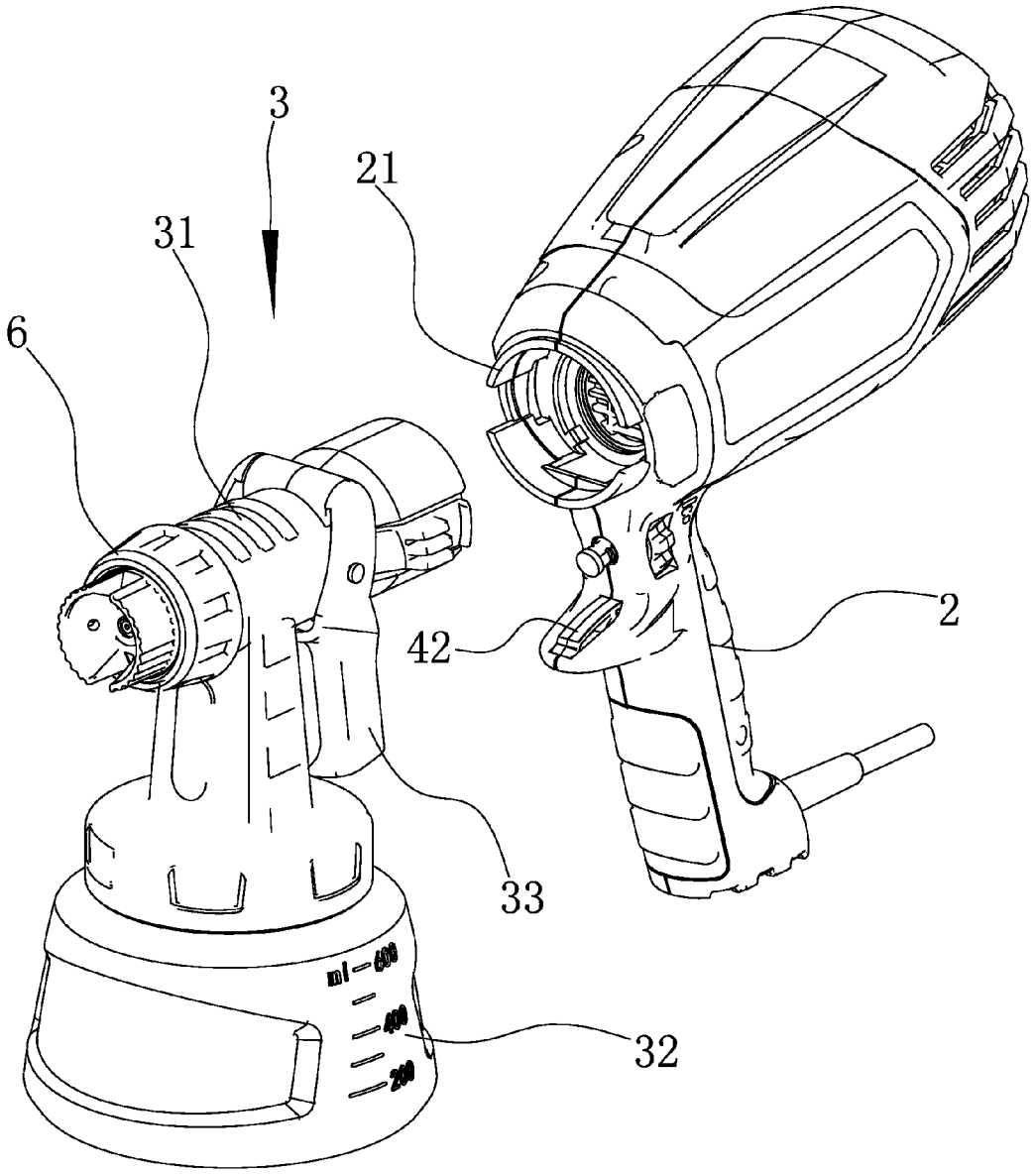
FIG. 2 is a three-dimensional view of the handle and one painting component detached from the handle of the present utility model.
Figure 3:
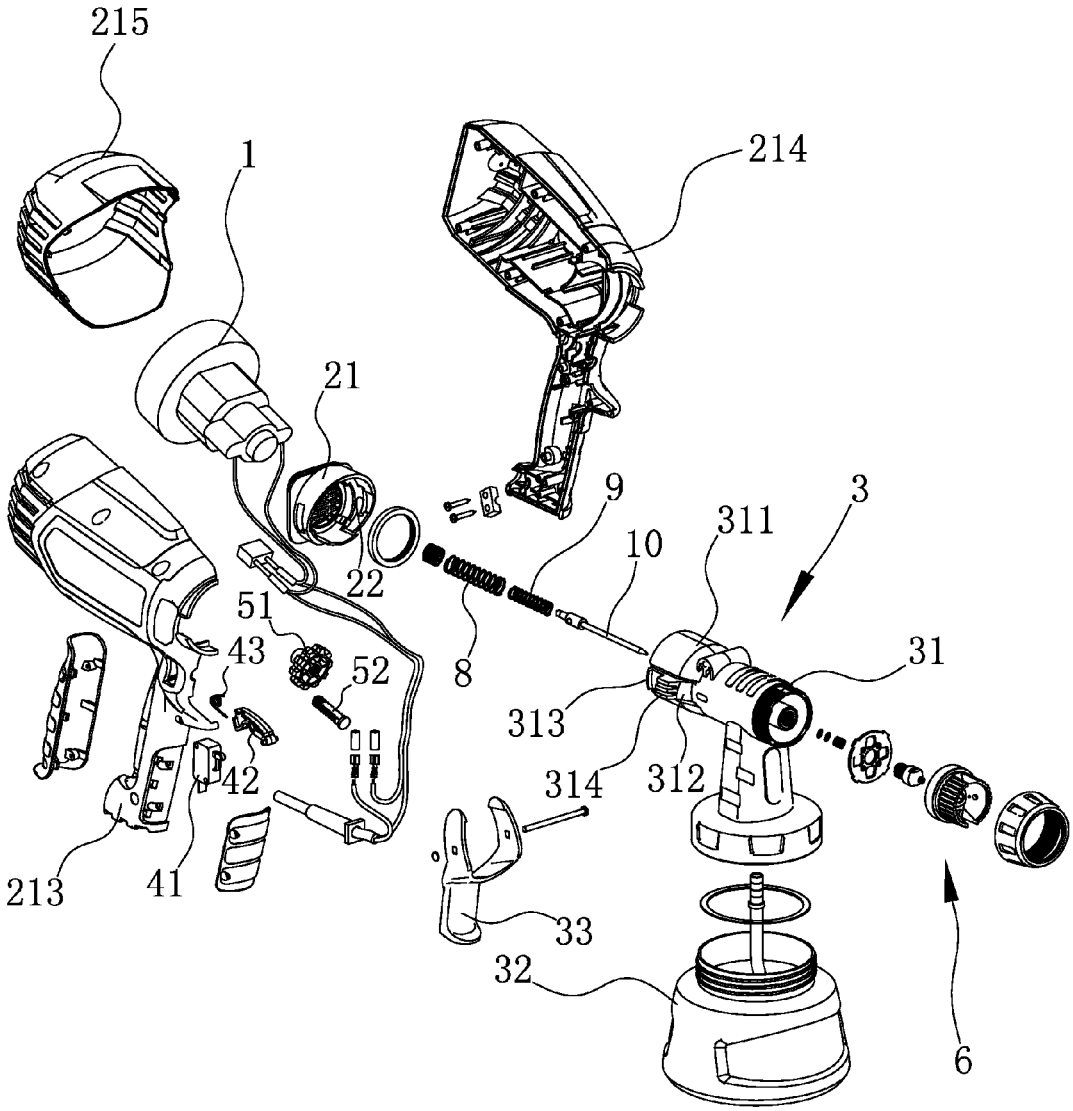
FIG. 3 is an exploded three-dimensional view of the electric spray gun of the present utility model, consisting of a handle and one painting component.

Referring to FIG. 1 to FIG. 3, in the above embodiment of the present utility model, an air outlet port 21, which communicates with the pump 1, is provided on the handle 2. An air inlet connector 311 is provided on the gun pipe 31. The air inlet connector 311 is inserted into the air outlet port 21 and clamped onto the air outlet port 21. An engagement slot 22 is provided inside the air outlet port 21; a resilient plate 312 is formed on the air inlet connector 311; an engagement block 313 is provided on the moveable end of the resilient plate 312, and the engagement block 313 is engaged with the engagement slot 22; a pressing component 314 is provided on the resilient plate 312. The above clamping structure has a simple structure. It is easy to operate, and such structure has good sealing. While detaching the gun pipe 31 from the handle 2, the user only needs to press the pressing component 314. The pressing component 314 will deform the resilient plate 312, which detaches the engagement block 313 on the moveable end of the resilient plate 312 from the engagement slot 22 in the air outlet port 21; thus detaching the gun pipe 31 from the handle 2. When connecting the gun pipe 31 with the handle 2, the user only needs to align and engage the air inlet connector 311 on the gun pipe 31 with the air outlet port 21 on the handle 2, and let the engagement block 313 clamped onto the engagement slot 22.

Referring to FIG. 1 to FIG. 3, in the above embodiment of the present utility model, a triggering component is provided on the handle 2, a trigger 33 is provided on the gun pipe 31, and the trigger 33 engages the triggering component. Since the handle 2 and the gun pipe 31 are detachable, the present spray gun has the triggering component, which controls the pump 1, placed on the handle 2, and the trigger 33 activates the triggering component on the handle 2 which therefore activates the pump 1. Because of this structure, there is no electrical circuit between the handle 2 and the gun pipe 31, which makes the product more reliable and facilitates detachment and assembly between the handle 2 and the gun pipe 31.

Referring to FIG. 1 to FIG. 3 and FIG. 7, in the above embodiment of the present utility model, the triggering component comprises a trigger switch 41 provided in the handle 2 and a moving block 42 hinged to the handle 2; a resilient button 411 is provided on the trigger switch 41; one end of the moving block 42 is hinged to the handle 2 while another end thereof is moveable; the moveable end is engaged with the resilient button 411, and the trigger 33 presses the moving block 42 in a sliding fashion. A spring 43 is also provided on the handle 2; the spring 43 drives the moving block 42 back to its original position. The trigger 33 slides and presses the moveable block 42, thus driving the moveable block 42 to swing along the hinging axis; the moveable end of the moveable block 42 presses the resilient button 411. This triggering component only has few components and a simple structure, but it has a high sensitivity; due to this structure, even after the triggering switch 41 has been switched on by the trigger 33, the user is still able to control the needle seal's position inside the gun pipe 31; thus making the spray gun easier to use.

Figure 7:
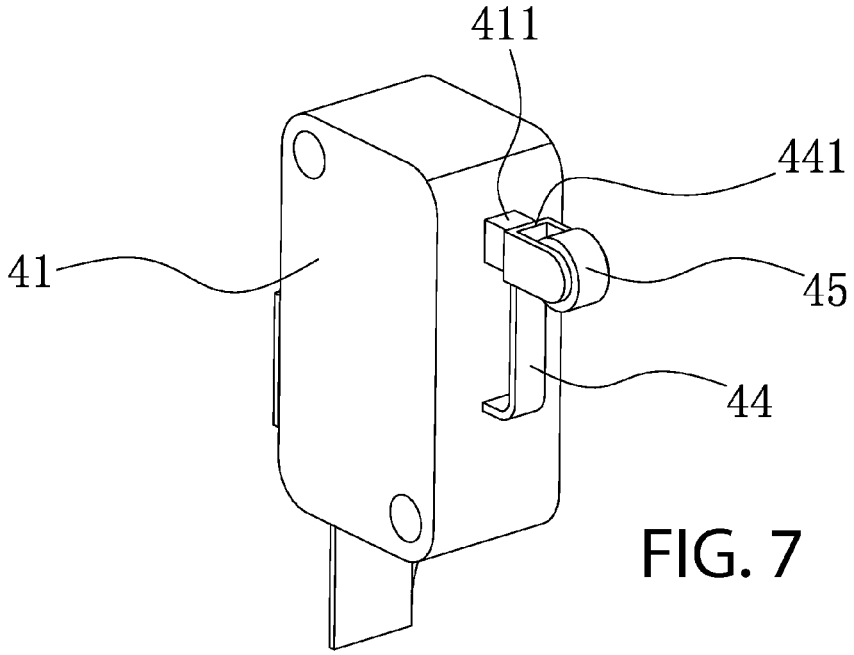
FIG. 7 is the three-dimensional view of the triggering switch of the present utility model.

Referring to FIG. 3 and FIG. 7, in the above embodiment of the present utility model, a resilient beam 44 is provided on the trigger switch 41; one end of the resilient beam 44 is fixed to the trigger switch 41; a pressing portion 441 is provided on the other end of the resilient beam 44; one side of the pressing portion 441 is engaged with the resilient button 411; a roller 45 is provided on the other side of the pressing portion 441; the moving end of the moveable block 42 is engaged with the roller 45 in a sliding pressing fashion; thus it deforms the resilient beam 44 and presses the resilient button 411, which turns on the trigger switch 41. Such structure changes the action between the moveable block 42 and the resilient button 411 from sliding to pressing. It also changes from sliding friction to rolling friction. Thus such structure makes the spray gun more reliable and adjustable while using, and it prevents the moveable block 42 from being stuck with the resilient button 411, causing the resilient button 411 or the moveable block 42 to be unable to return to its original position.

Referring to FIG. 1 to FIG. 3, in the above embodiment of the present utility model, an adjustable trigger stopper 5 is provided on the handle 2. While the trigger 33 is pulled, the trigger 33 engages with the trigger stopper 5. The trigger stopper 5 limits the trigger's 33 movement. While using the spray gun, the user can adjust the trigger stopper 5 to a predefined position. As the user pulls the trigger 33 to the predefined position, the trigger 33 engages with the trigger stopper 5. Therefore, the user's hand, which pulls the trigger, will not shake due to the working of the spray gun, and it will not cause any unevenness on the painting result.

Referring to FIG. 1 to FIG. 3, in the above embodiment of the present utility model, the trigger stopper 5 comprises an adjusting nut 51 and a screw 52 paired with each other; the rotation of the adjusting nut 51 drives the screw 52 to perform linear movements; the trigger 33 is engaged with the screw 52 while the trigger 33 is pulled. The adjusting nut 51 is inlaid into the handle 2 in a rotatable fashion; one end of the screw 52 is inserted into the handle 2 and paired with the adjusting nut 51; another end of the screw 52 remains in the open and engages with the trigger 33 when the trigger 33 is pulled; the external thread of the screw 52 is paired with the internal thread of the adjusting nut 51; the rotation of the adjusting nut 51 drives the screw 52 to perform linear movements. Such trigger stopper 5 only has few components and a simple structure; it is easy to use and the user is able to do minor adjustments with one hand, which improves the painting effect.

Referring to FIG. 1, in the above embodiment of the present utility model, a paint passage and an air passage are provided within the gun pipe 31, and a paint pipe 315 and an air pressure pipe 316 are provided at the connecting part between the paint tank 32 and the gun pipe 31; the paint pipe 315 is in communication with the paint passage, and the air pressure pipe 316 is in communication with the air passage. The paint pipe 315 and the air pressure pipe 316 are inserted into the paint tank 32, which not only makes the product more aesthetic, but also prevents air leak or damage to the air pressure pipe 316.

Referring to FIG. 1 to FIG. 3 and FIG. 6, in the above embodiment of the present utility model, a nozzle 6 is provided at the front end of the gun pipe 31; the nozzle 6 comprises a head sealing ring 61, a paint nozzle 62, an air flow cap 63, and a positioning ring 64; a positioning hole 611 is formed on the head sealing ring 61, and a positioning block 631 is provided on the air flow cap 63; the positioning hole 611 is paired with the positioning block 631; the paint nozzle 62 secures the head sealing ring 61 to the gun pipe 31; the positioning ring 64 secures the air flow cap 63 to the gun pipe 31 in a rotatable fashion. Forming a positioning hole 611 on the head sealing ring 61 saves the adjusting ring in the prior art; thus saving raw material and lowers manufacturing cost. It also increases assembling efficiency. Preferably, there are eight positioning holes 611, and they are evenly distributed on the head sealing ring 61 in a ring shape. Similarly, there are four positioning blocks 631, and they are evenly distributed on the air flow cap 63 in a ring shape. Rotating the air flow cap 63 drives the positioning block 631 to move from one positioning hole 611 to an adjacent positioning hole 611. As the positioning block 631 moves from one positioning hole 611 to another, the air flow cap 63 rotates 45 degrees. The air outlet port changes as the air flow cap 63 rotates, causing a change in spraying shape. The spraying shape alternates among, for example, a horizontal line shape, a ring shape, and a vertical line shape.

Figure 4:
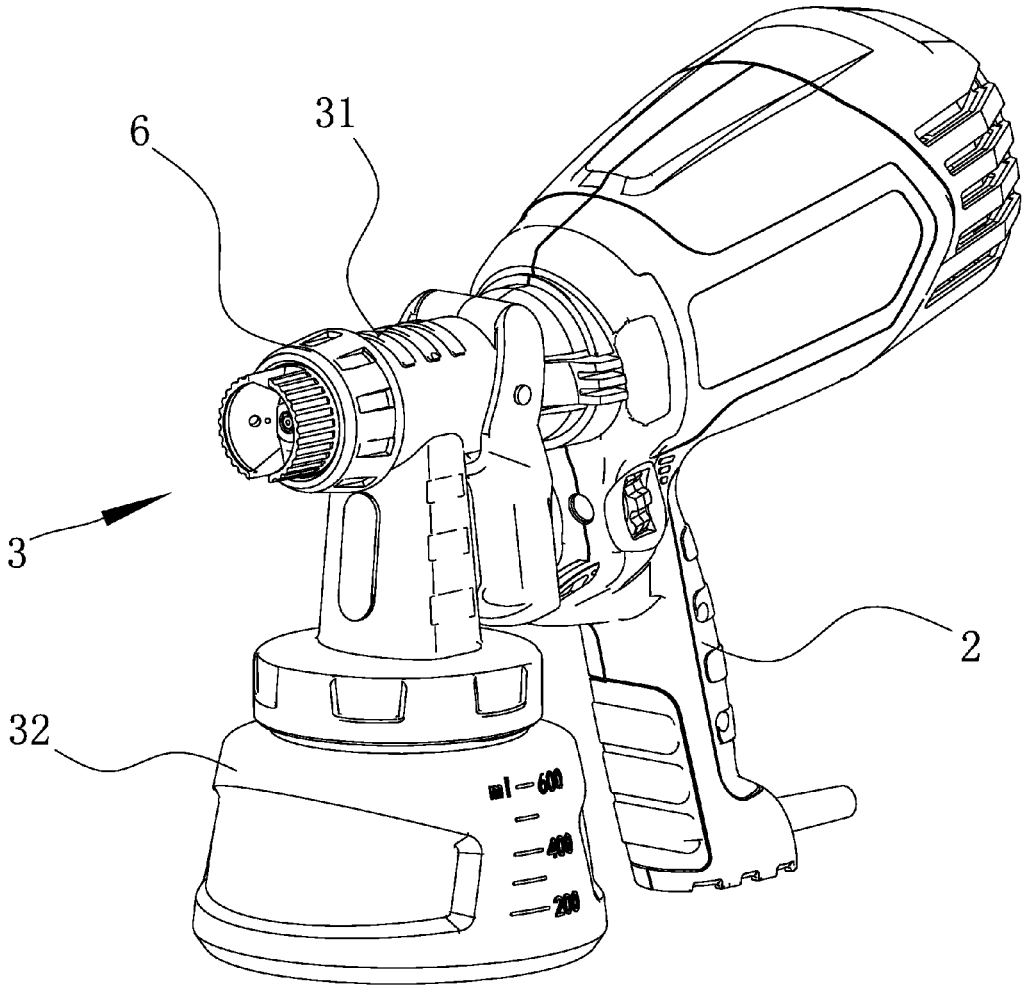
FIG. 4 is a three-dimensional view of the electric spray gun of the present utility model, consisting of a handle and one painting component.
Figure 5:
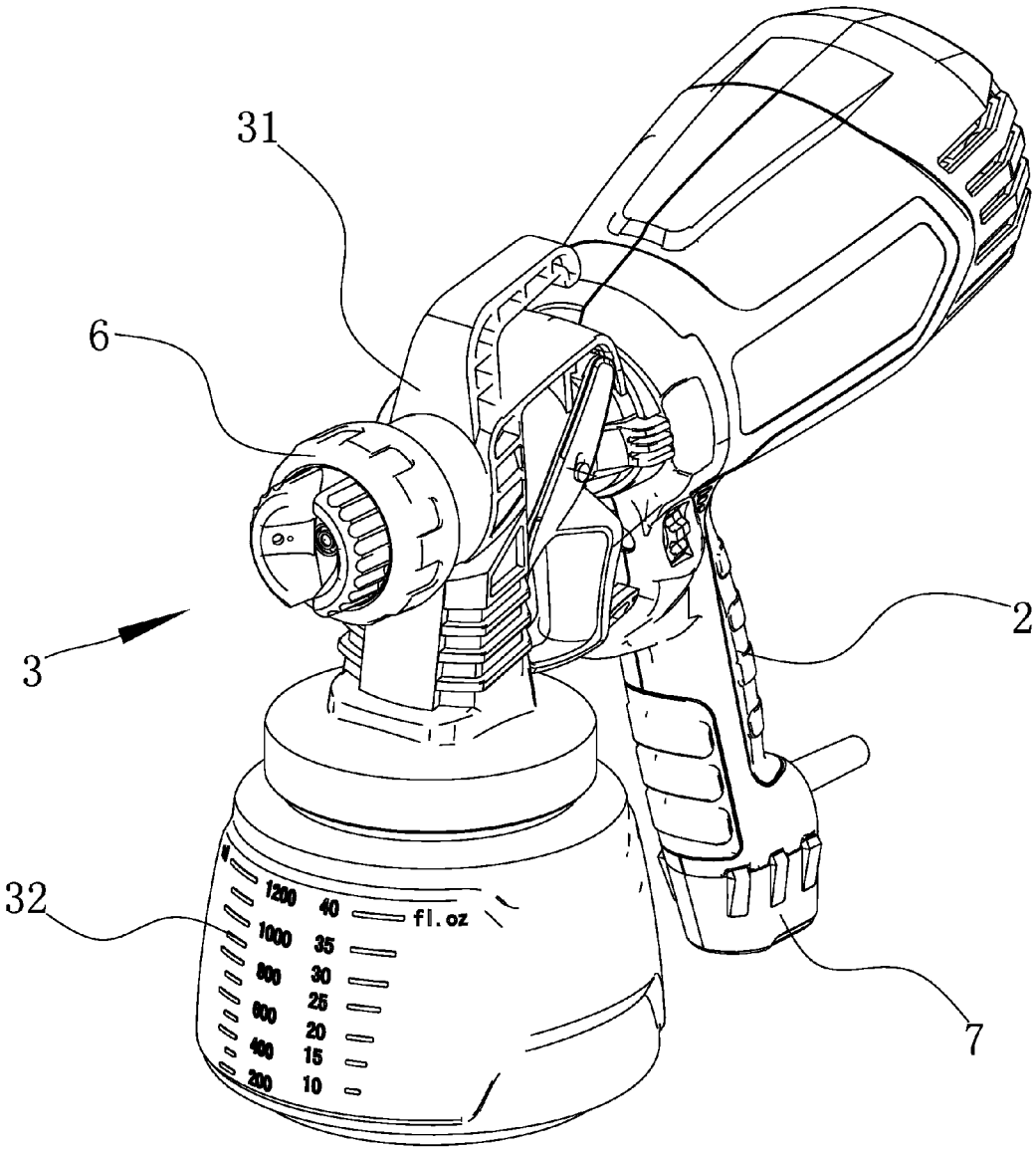
FIG. 5 is a three-dimensional view of the electric spray gun of the present utility model, consisting of a handle and another painting component.
Figure 6:
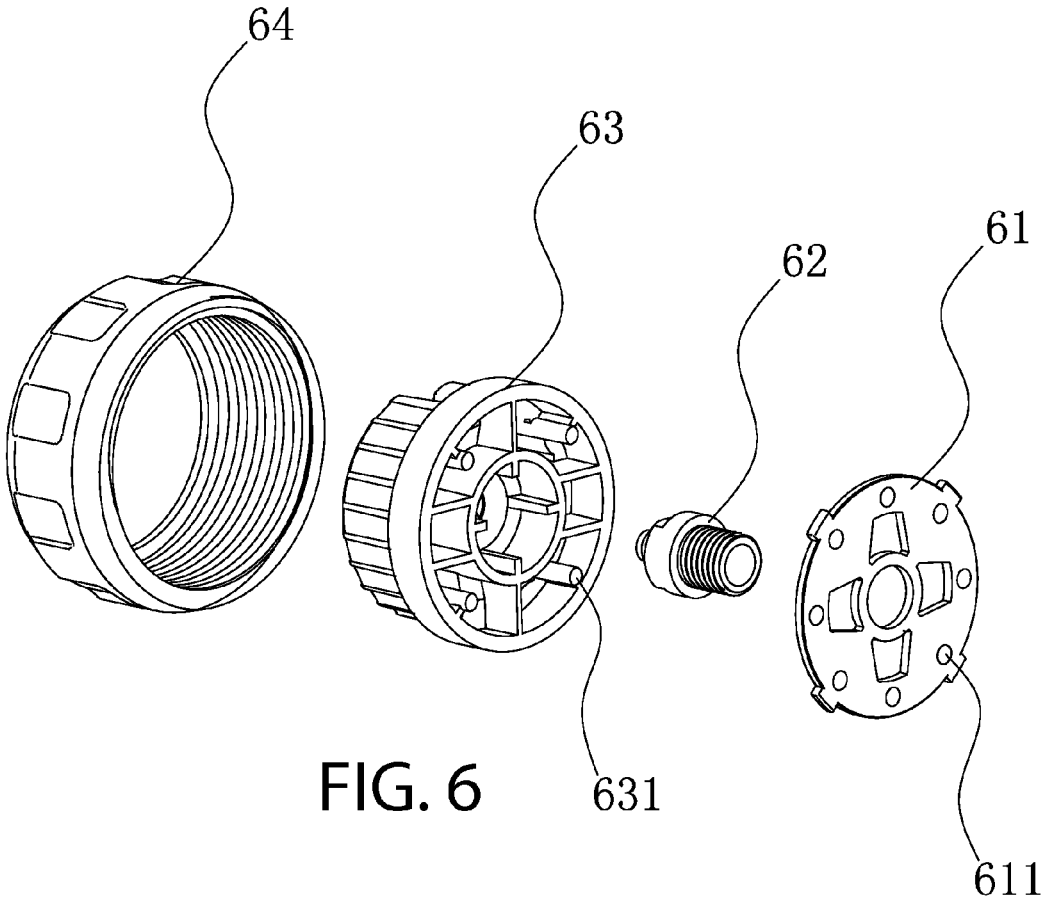
FIG. 6 is an exploded view of the nozzle structure of the present utility model.

Referring to FIG. 4 and FIG. 5, in the above embodiment of the present utility model, a rubber end cap 7 is provided on the bottom of the handle 2; the rubber end cap 7 is inserted into the handle 2; an inserting hole is formed on the bottom of the handle 2, and an inserting block is formed on the rubber end cap 7; the inserting block is inserted into the inserting hole. In a plurality of said painting components 3, each paint tank 32 has a different size, and each gun pipe 31 has a different outer diameter. In the present utility model, since each painting component 3 is used for different paint, it is necessary to make each paint tank 32 a different size, and each gun pipe 31 a different outer diameter. As a result, the height of each painting component is different. The handle's 2 height matches the height of the smallest painting component 3. Thus, while engaging with other painting components 3, the handle 2 may be too short; the bottom of the handle 2 is not level with the bottom of the paint tank 32, which effects stability. Adding a detachable rubber end cap 7 at the bottom of the handle 2 simply solves the above problem. The connection between the rubber end cap 7 and the handle 2 has a simple structure, which makes it easy to connect and disconnect the rubber end cap Referring to FIG. 1, in the above embodiment of the present utility model, a pump cavity is provided on the handle 2, the pump 1 is secured inside the pump cavity. By placing the pump 1 inside the handle's 2 pump cavity, it makes the integrated electric spray gun more agile and easier to operate.

Referring to FIG. 3, in the above embodiment of the present utility model, the handle 2 consists of a body part and a cover 215; the body part consists of a left cavity 213 and a right cavity 214, where the left cavity 213 is fastened to the right cavity 214; the cover 215 is fastened to one end of the body part; an air hole is provided on the body part, and the air outlet port 21 is fastened in the air hole. The handle 2 only has few components and a simple structure. Clamping the air outlet port 21 onto the handle 2 makes a tight connection; it also increases the assembling efficiency.

Referring to FIG. 1 and FIG. 3, in the above embodiment of the present utility model, a trigger spring 8, which drives the trigger 33 back to its original position, and a needle seal spring 9, which drives the needle seal 10 back to its original position, are provided inside the gun pipe 31; the needle seal spring 9 is located inside the trigger spring. Compared with the prior art, which typically uses one spring to drive the trigger 33 and the needle seal 10 back to their original positions, the present structure has a lower failure rate, and the product's service life is extended.

The embodiments of the invention in which an exclusive property or privilege is claimed are defined as follows:

1. A multifunctional electric spray gun, comprising:

a handle;

a pump coupled to the handle;

a painting component selected from a plurality of painting components, wherein each of the plurality of painting components is respectively fastenable to the handle in a detachable fashion to form the electric spray gun, and wherein each of the plurality of painting components comprises a gun pipe that is fastenable to the handle in a detachable fashion and a paint tank that is coupled to the gun pipe;

an air outlet port configured to communicate with the pump, wherein the air outlet port is provided on the handle;

an air inlet connector provided on the gun pipe, wherein the air inlet connector is configured to be inserted into the air outlet port and clamped onto the air outlet port;

an engagement slot provided inside the air outlet port;

a resilient plate formed on the air inlet connector;

an engagement block provided on a moveable end of the resilient plate, wherein the engagement block is configured to be engaged with the engagement slot; and a pressing component provided on the resilient plate.

2. The multifunctional electric spray gun according to claim 1, further comprising:

a triggering component provided on the handle; and a trigger provided on the gun pipe, wherein the trigger is configured to engage the triggering component.

3. The multifunctional electric spray gun according to claim 2, wherein:

the triggering component comprises a trigger switch provided in the handle and a moveable block hinged to the handle;

a resilient button is provided on the trigger switch;

a first end of the moveable block is hinged to the handle while a second end is moveable;

the moveable second end is configured to engage with the resilient button; and the trigger is configured to press the moveable block in a sliding fashion.

4. The multifunctional electric spray gun according to claim 3, further comprising:

a resilient beam provided on the trigger switch, wherein a first end of the resilient beam is fixed to the trigger switch;

a pressing portion provided on a second end of the resilient beam, wherein a first side of the pressing portion is engaged with the resilient button; and a roller provided on a second side of the pressing portion, wherein the moving end of the moveable block is configured to engage with the roller in a sliding pressing fashion, and wherein the moveable block is configured to drive the pressing portion to press the resilient button.

5. The multifunctional electric spray gun according to claim 2, further comprising:

an adjustable trigger stopper provided on the handle, wherein the trigger is configured to engage with the trigger stopper in response to the trigger being pulled.

6. The multifunctional electric spray gun according to claim 5, wherein:

the adjustable trigger stopper comprises an adjusting nut rotatably engaging a screw;

rotation of the adjusting nut drives the screw to perform linear movements; and the trigger is configured to engage with the screw in response to the trigger being pulled.

7. The multifunctional electric spray gun according to claim 6, wherein:

the adjusting nut is inlaid into the handle in a rotatable fashion;

a first end of the screw is inserted into the handle and paired with the adjusting nut;

a second end of the screw remains exposed and engages with the trigger when the trigger is pulled;

an external thread of the screw is paired with an internal thread of the adjusting nut; and the rotation of the adjusting nut drives the screw to perform linear movements.

8. The multifunctional electric spray gun according to claim 1, further comprising:

a paint passage and an air passage provided within the gun pipe; and a paint pipe and an air pressure pipe provided at a connection between the paint tank and the gun pipe, wherein the paint pipe is configured to communicate with the paint passage, and wherein the air pressure pipe is configured to communicate with the air passage.

9. The multifunctional electric spray gun according to claim 1, further comprising:

a nozzle provided at a front end of the gun pipe, wherein the nozzle comprises a head sealing ring, a paint nozzle, an air flow cap, and a positioning ring;

a positioning hole formed on the head sealing ring; and a positioning block provided on the air flow cap, wherein the positioning hole is paired with the positioning block, wherein the paint nozzle is configured to secure the head sealing ring to the gun pipe, and wherein the positioning ring is configured to secure the air flow cap to the gun pipe in a rotatable fashion.

10. The multifunctional electric spray gun according to claim 1, further comprising:

a rubber end cap provided on a bottom of the handle, wherein the rubber end cap is inserted into the handle;

a hole formed on the bottom of the handle; and an inserting block formed on the rubber end cap, wherein the inserting block is inserted into the hole.

11. The multifunctional electric spray gun according to claim 1, wherein the plurality of painting components comprise paint tanks having different sizes and gun pipes having different outer diameters.

12. The multifunctional electric spray gun according to claim 1, wherein a pump cavity is provided on the handle and wherein the pump is secured inside the pump cavity.

13. The multifunctional electric spray gun according to claim 1, wherein:

the handle comprises a body part and a cover;

the body part comprises a left cavity and a right cavity, wherein the left cavity is fastened to the right cavity;

the cover is fastened to one end of the body part;

an air hole is provided on the body part; and the air outlet port is fastened in the air hole.

14. The multifunctional electric spray gun according to claim 3, further comprising:

a spring provided on the handle, wherein the spring is configured to drive the moveable block back to its original position.

15. The multifunctional electric spray gun according to claim 2, further comprising:

a trigger spring configured to drive the trigger back to its original position; and a needle seal spring configured to drive a needle seal back to its original position, wherein the trigger spring and the needle seal spring are provided inside the gun pipe, and wherein the needle seal spring is located inside the trigger spring.

* * * * *